US011428469B2

(12) United States Patent
Gray

(10) Patent No.: US 11,428,469 B2
(45) Date of Patent: Aug. 30, 2022

(54) FUMING ENCLOSURE WITH SELECTIVE HEATING APPARATUS

(71) Applicant: LABCONCO CORPORATION, Kansas City, MO (US)

(72) Inventor: Brandon Gray, Kansas City, MO (US)

(73) Assignee: LABCONCO CORPORATION, Kansas City, MO (US)

( * ) Notice: Subject to any disclaimer, the term of this patent is extended or adjusted under 35 U.S.C. 154(b) by 782 days.

(21) Appl. No.: 15/444,653

(22) Filed: Feb. 28, 2017

(65) Prior Publication Data

US 2018/0245848 A1 Aug. 30, 2018

(51) Int. Cl.
*F27D 3/00* (2006.01)
*F27B 17/02* (2006.01)

(52) U.S. Cl.
CPC ..... *F27B 17/02* (2013.01); *F27M 2003/15* (2013.01)

(58) Field of Classification Search
CPC .. G01N 35/0099; F23J 11/00; F27M 2003/15; F27B 17/02; F27B 19/02
See application file for complete search history.

(56) References Cited

U.S. PATENT DOCUMENTS 3,641,250 A * 2/1972 Hintenberger ..... F27B 17/02 373/112
4,297,383 A * 10/1981 Bourdon ..... A61B 5/1172 118/31.5
5,315,091 A * 5/1994 O'Brien ..... F27B 17/02 164/136
5,395,445 A 3/1995 Bohanan
5,465,765 A * 11/1995 Martindale ..... A61B 5/1172 118/31.5
6,257,480 B1 7/2001 Furumoto et al.
6,423,946 B1 7/2002 Berka et al.
6,660,054 B2 12/2003 Manna et al.
6,897,410 B1 5/2005 Ho et al.
2012/0141669 A1* 6/2012 Stones ..... A61B 5/1172 427/145

FOREIGN PATENT DOCUMENTS

JP 01281394 11/1989
WO WO 2014/142934 9/2014
WO WO-2014142934 A1 * 9/2014 ..... A61B 5/1172

* cited by examiner

*Primary Examiner* — Helena Kosanovic
*Assistant Examiner* — Ahmad Abdel-Rahman
(74) *Attorney, Agent, or Firm* — Stinson LLP

(57) ABSTRACT

A fuming enclosure including a heating element and a moveable support or barrier. The heating element may heat a receptacle containing a volatile component. The moveable support or barrier is moveable between a first position, in which the volatile component is not heated by the heating element, and a second position, in which the volatile component is heated by the heating element. The moveable support or barrier may be moveable while maintaining the enclosure sealed. The moveable support or barrier may be automatically moveable. A fuming enclosure with a one-way seal configured to prevent fumes from escaping the enclosure and allow volatile component to flow through the seal into the enclosure while the enclosure is sealed.

18 Claims, 14 Drawing Sheets

FUMING ENCLOSURE WITH SELECTIVE HEATING APPARATUS

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of the Invention

The present invention relates to a fuming enclosure and, more particularly, to a fuming enclosure with enhanced safety, repeatability, and precision control.

2. Description of Related Art

Fuming enclosures are used to make visible latent fingerprints on objects. An object that may contain a latent fingerprint is placed within the enclosure. Cyanoacrylate is heated within the enclosure so that it vaporizes into fumes, which adhere to the latent fingerprints to enhance visibility and preserve the fingerprints for further handling.

For safety, it is generally desired to close all doors and seal all openings of a fuming enclosure before the cyanoacrylate is heated. Following this procedure reduces the risk of exposure to cyanoacrylate fumes and the risk of being burned by a heat source within the enclosure. In order to follow such a procedure, the cyanoacrylate is typically placed within a receptacle that is set upon a heat source. All doors of the enclosure are closed and all openings are sealed. Then, the heat source is energized to heat and vaporize the cyanoacrylate so that it fumes objects within the enclosure. The cyanoacrylate is gradually heated as the temperature of the heat source increases. This process may be referred to as a traditional fuming process.

Many law enforcement agencies, however, prefer to follow a process known as a microburst fuming process. In the microburst fuming process, the cyanoacrylate is not exposed to heat from the heat source until the heat source has achieved a relatively high, pre-specified temperature. Microburst fuming offers advantages to those skilled in the art, which may include reduced cyanoacrylate adhesion to background (hand smudges), differentiated ridge detail, and faster processing time than the traditional fuming process. In order to follow the microburst fuming process in a conventional fuming enclosure, an operator must turn on the heat source, open a door to access the heat source, add the cyanoacrylate to a receptacle in contact with the heat source and then quickly close the door. The operator may also need to disengage door locks of the fuming enclosure in order to open the door while the heat source is powered on. Following this process is potentially hazardous to the operator and those in the vicinity of the fuming enclosure because fumes from the heated cyanoacrylate may escape the fuming enclosure before the door is closed. Further, the heat source may burn the operator when the operator reaches in to deposit the cyanoacrylate within the enclosure. The process is also not highly repeatable or precise because it is manually carried out by an operator that must hurry in order to avoid dangerous exposure to cyanoacrylate fumes.

BRIEF SUMMARY OF THE INVENTION

A fuming enclosure in accordance with one embodiment of the invention described herein is operable to contain and circulate the fumes of a volatile component. The fuming enclosure includes outer walls defining an enclosure having a sealed interior. A heating element is positioned within the interior. The heating element is operable to be energized to heat a receptacle containing a volatile component to a specified temperature. A moveable support is positioned within the interior. The support is configured to hold the receptacle within the interior in a non-contact position such that the receptacle is not in contact with the heating element. The support is configured to move the receptacle to a contact position such that the receptacle is in contact with the heating element while maintaining the enclosure sealed.

Alternatively, the moveable support may be a moveable barrier that is positioned within the interior and configured to be positioned in a blocking position between the receptacle and the heating element in such a manner as to inhibit the transfer of heat from the heating element to the receptacle. The moveable barrier may be moved to a non-blocking position that does not inhibit the transfer of heat from the heating element to the receptacle while maintaining the enclosure sealed. Because the fuming enclosure maintains the enclosure sealed while moving the receptacle to the contact or non-blocking position, an operator is not exposed to potentially dangerous fumes from the volatile component being heated within the receptacle and the operator is not exposed to burns from contact with the heating element.

In another embodiment, an apparatus for selectively heating a volatile component in a sealed fuming enclosure includes a heating element and a moveable support. The heating element has a heating surface capable of heating a receptacle containing a volatile component to a pre-selected temperature. The moveable support is configured to hold the receptacle in a non-contact position such that the receptacle is not in contact with the heating surface. The moveable support is configured to automatically position the receptacle in a contact position such that the receptacle is in contact with the heating surface, preferably upon the heating surface reaching a pre-selected temperature.

Alternatively, the moveable support may be a moveable barrier that is configured to be positioned in a blocking position between the receptacle and the heating surface in such a manner as to inhibit the transfer of heat from the heating surface to the receptacle. The moveable barrier may be automatically moved to a non-blocking position that does not inhibit the transfer of heat from the heating surface to the receptacle upon the heating surface reaching a pre-selected temperature. Automatic movement of the moveable support or barrier enhances the repeatability and precision of use of the apparatus to heat a volatile component.

In another embodiment of fuming enclosure described herein, the fuming enclosure includes outer walls defining an enclosure having a sealed interior, a heating element positioned within the interior, and a one-way seal operable to receive a conduit extending through a portion of the outer walls. The heating element is operable to be energized to heat a receptacle containing a volatile component to a specified, pre-selected temperature when the component is positioned within the receptacle. The conduit extends through the one-way seal from outside the enclosure into the interior adjacent the receptacle. The seal is configured to prevent the flow of material from within the interior to the outside of the enclosure and to permit the flow of the volatile component through the conduit into the receptacle within the interior while maintaining the enclosure sealed.

Preferably, the fuming enclosures and apparatuses described above are operable to work as or with a fingerprint processing cabinet and the volatile component is cyanoacrylate that can react with and expose latent fingerprints on objects positioned within the cabinet. The fuming enclosures and apparatuses are operable to work with either a traditional fuming process, which gradually heats a volatile component, or a microburst fuming process, which exposes a volatile component to a pre-heated heating element in order to rapidly heat the volatile component.

Additional aspects of the invention, together with the advantages and novel features appurtenant thereto, will be set forth in part in the description which follows, and in part will become apparent to those skilled in the art upon examination of the following, or may be learned from the practice of the invention. The objects and advantages of the invention may be realized and attained by means of the instrumentalities and combinations particularly pointed out in the appended claims.

DETAILED DESCRIPTION OF PREFERRED EMBODIMENT

Figure 1:
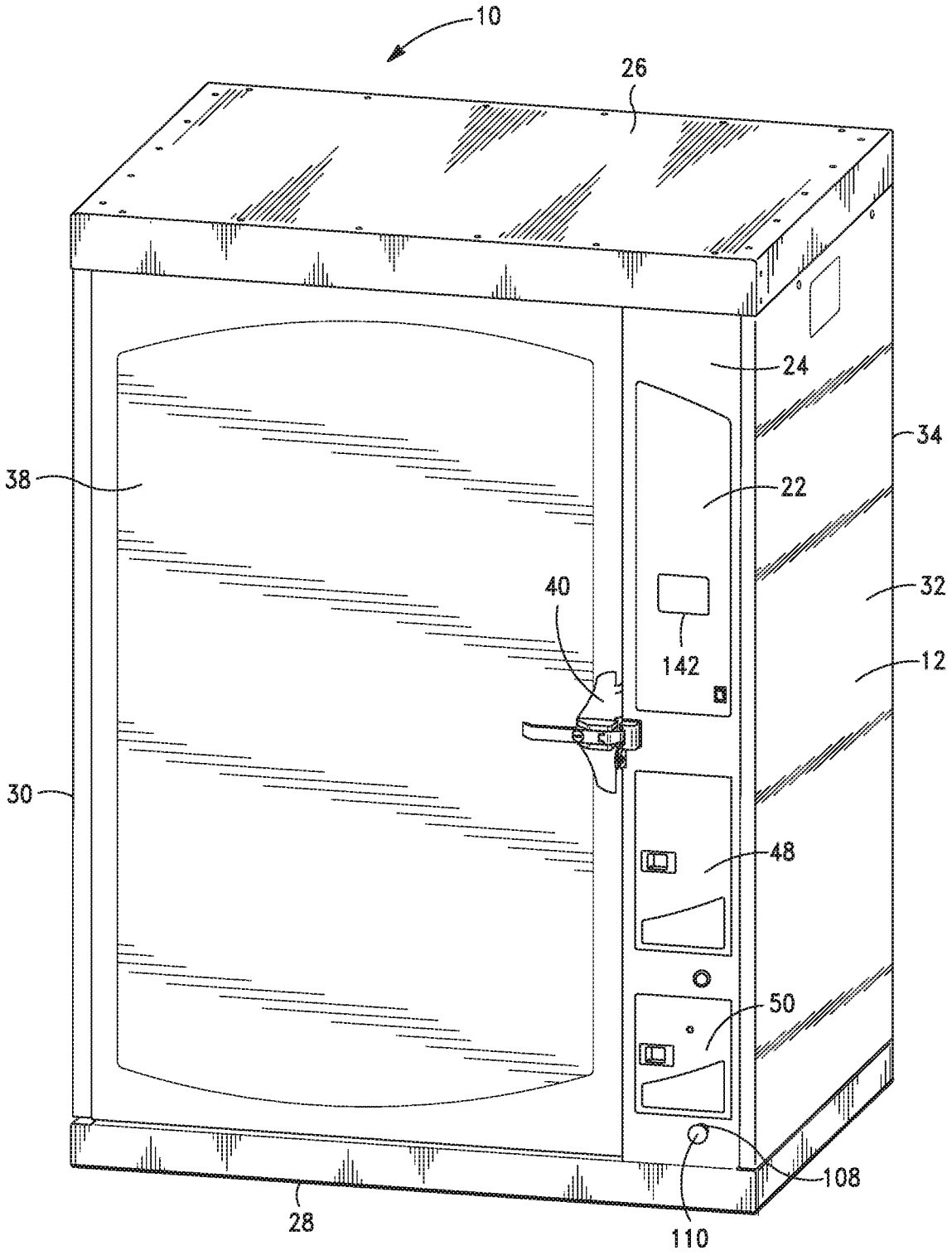
FIG. 1 is a perspective view of a fuming enclosure in accordance with one embodiment of the invention described herein.

A fuming enclosure in accordance with one embodiment of the invention disclosed herein is identified generally as 10 in FIG. 1. Fuming enclosure 10 includes a sealed chamber 12, a heating apparatus 14 (FIGS. 2-4B), a humidification system 16 (FIG. 2), a recirculation system 18 (FIG. 2), an exhaust system 20 (FIG. 7), and a control system 22 (FIG. 1). Fuming enclosure 10 is preferably a fingerprint processing cabinet that is operable to contain evidence, such as firearms or other objects that may present a latent fingerprint, in a sealed enclosure and circulate the fumes of a volatile component, such as cyanoacrylate, within the sealed enclosure so that the volatile component reacts and adheres to the latent fingerprint to make the latent fingerprint visible.

As described in detail herein, fuming enclosure 10 is operable to heat a volatile component either using a conventional method, in which the volatile component is placed in contact with a heating element before the heating element is heated to a desired temperature, or a microburst method, in which the volatile component is placed in contact with a heating element that has already been heated to a desired temperature. When used with the microburst method, fuming enclosure 10 is designed to automatically place the volatile component in contact with the heating element when the heating element reaches the desired temperature while maintaining the enclosure 10 sealed to enhance safety, precision control, and repeatability. It is within the scope of the invention, however, for an operator to manually place the volatile component in contact with the heating element.

Figure 2:
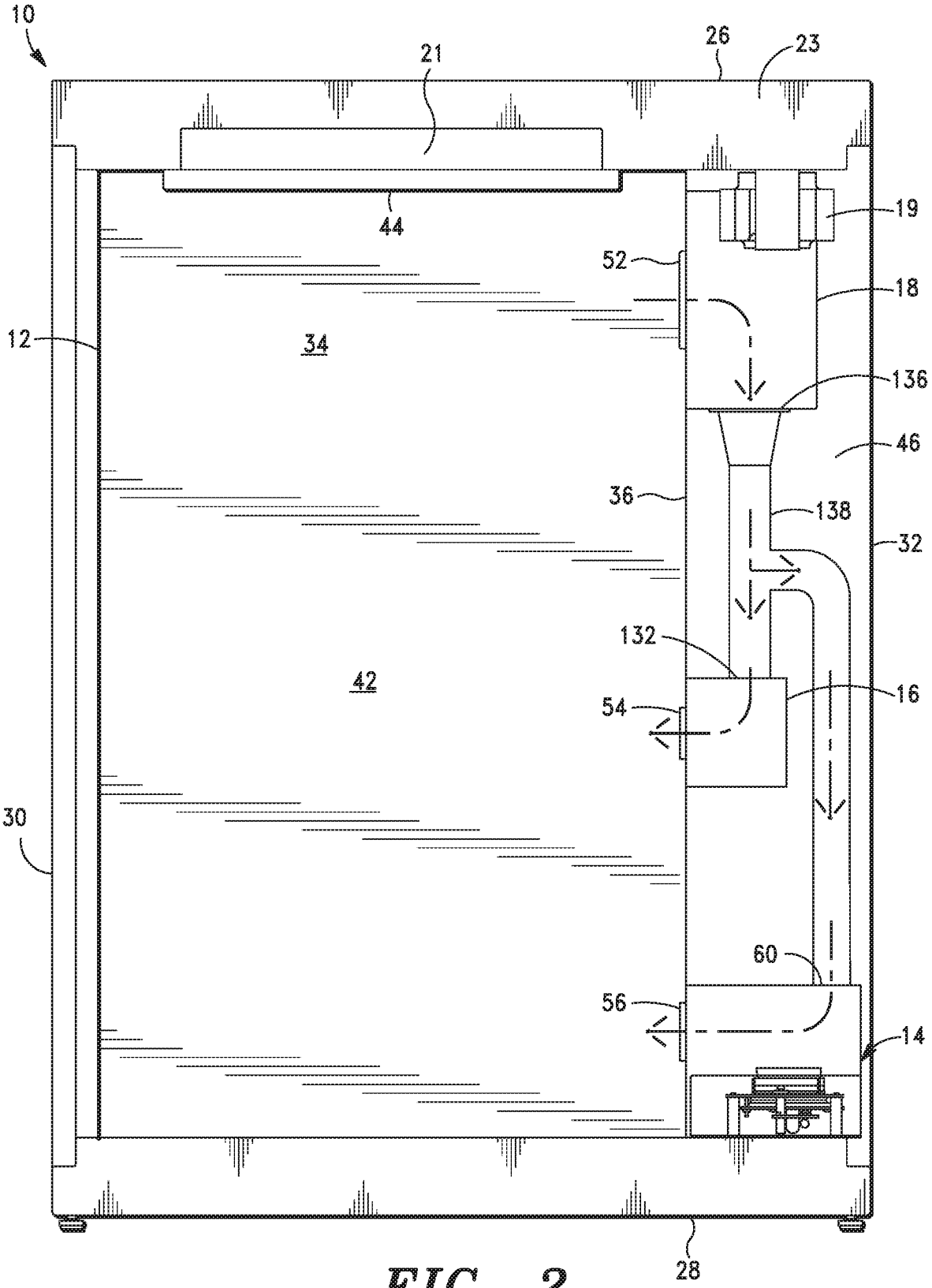
FIG. 2 is a front sectional view of the fuming enclosure shown in FIG. 1.

Referring to FIGS. 1 and 2, chamber 12 has a plurality of outer walls including a front wall 24, top wall 26, bottom wall 28, side walls 30 and 32, and rear wall 34 and an interior wall 36 that is positioned between side walls 30 and 32. A main door 38 is pivotably mounted to side wall 30 and moveable between an open position and the closed position shown in FIG. 1. A latch mechanism 40 is operable to latch and lock main door 38 to front wall 24. Top wall 26, bottom wall 28, side wall 30, rear wall 34, interior wall 36, and main door 38 define an enclosure with an interior 42. Interior 42 is sealed when main door 38 is in the closed position and latch mechanism 40 latches the main door 38 to front wall 24. When interior 42 is sealed, air, particulates, and potential contaminants cannot enter or exit the interior 42. When main door 38 is in the open position, a user can access interior 42 and place objects therein. Shelves (not shown) and a hanging rack 44 may be placed in interior 42 to support objects placed therein.

Top wall 26, bottom wall 28, side wall 32, rear wall 34, and interior wall 36 enclose an equipment chamber 46, within which is positioned heating apparatus 14, humidification system 16, recirculation system 18, exhaust system 20, and portions of control system 22. Front wall 24 includes a pair of openings and corresponding access doors 48 and 50. Access door 48 is moveable between a closed position, in which it seals equipment chamber 46 and an open position, in which it provides access to humidification system 16 allowing a user to add water to the system. Access door 50 is moveable between a closed position, in which it seals equipment chamber 46 and an open position, in which it provides access to heating apparatus 14 allowing a user to position a volatile component in the heating apparatus 14. Interior wall 36 includes a recirculation opening 52 to place interior 42 in fluid communication with recirculation system 18, a humidification opening 54 to place interior 42 in fluid communication with humidification system 16, and a fuming opening 56 to place interior 42 in fluid communication with heating apparatus 14. Interior wall 36 also preferably includes an exhaust inlet (not shown) that is positioned behind fuming opening 56 to place interior 42 in fluid communication with exhaust system 20. Rear wall 34 preferably includes an exhaust outlet (not shown) to place exhaust system 20 in fluid communication with the atmosphere surrounding the fuming enclosure 10.

Heating apparatus 14, shown in FIGS. 3A-4B, is designed to selectively heat a volatile component in accordance with either the conventional or microburst fuming methods. Referring to FIG. 4A, heating apparatus 14 includes a heating enclosure 58 that is positioned within equipment chamber 46. Heating enclosure 58 includes an inlet 60 that is in fluid communication with recirculation system 18 and an outlet 62 that is generally aligned with the fuming opening 56 in interior wall 36. Besides inlet 60, outlet 62, and the opening for door 50, heating enclosure 58 is preferably otherwise sealed. Heating apparatus 14 includes a heating element 64, a moveable support 66, and a frame 68 each positioned within the heating enclosure 58.

The heating element 64 has a heating surface that is operable to be energized to heat a receptacle 70 containing a volatile component to a specified, pre-selected temperature when the receptacle 70 is positioned in contact with or is close to the heating element 64. Heating element 64 is preferably heated with electricity and is capable of heating to a temperature between approximately 37 to 315 degrees Celsius in 1 degree increments.

Figure 3A:
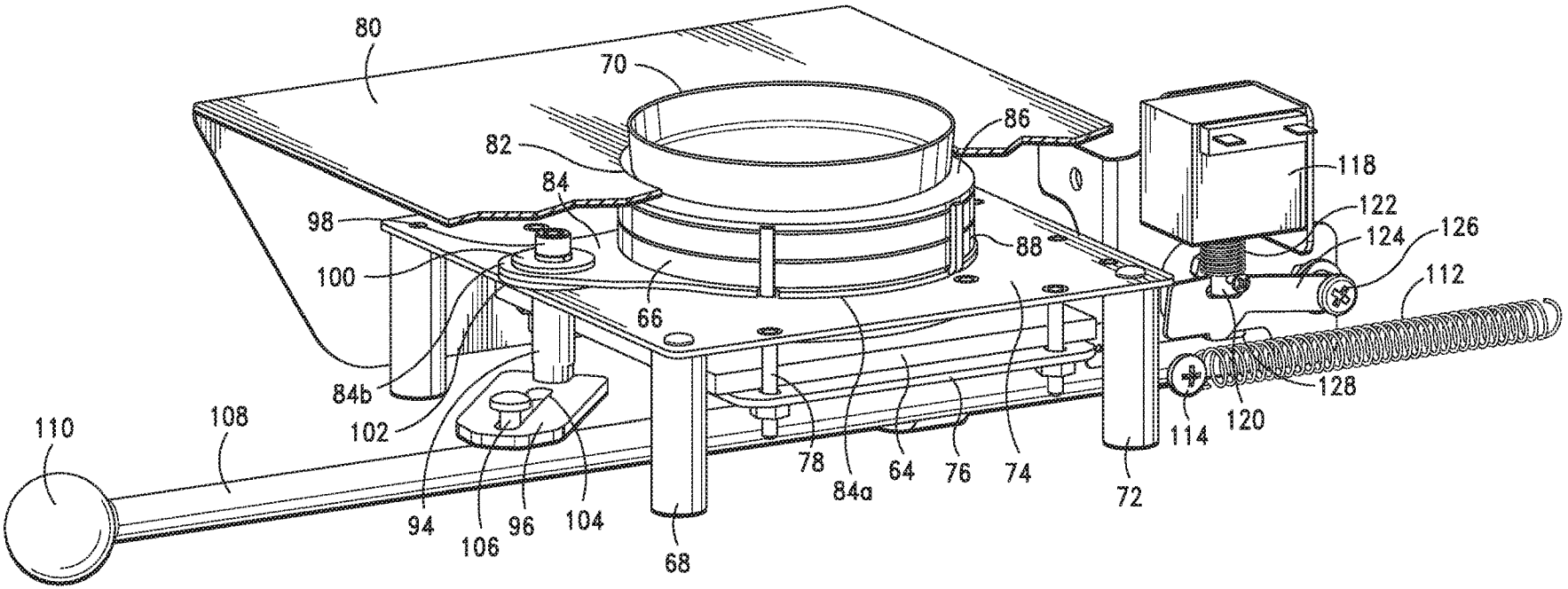
FIG. 3A is a perspective view of a heating apparatus of the fuming enclosure shown in FIG. 1 showing a support and receptacle in a non-contact position.

Frame 68 includes four legs, one of which is identified as 72 in FIG. 3A, that support a top surface 74. A lower surface 76 is suspended beneath the top surface 74 with rods, one of which is identified as 78, extending downward from top surface 74. Lower surface 76 supports heating element 64. Top surface 74 includes an opening 79, shown in FIG. 3B, that is positioned above heating element 64. A receptacle constraint plate 80 is generally parallel to and is positioned above top surface 74. Receptacle constraint plate 80 includes an opening 82 that is positioned above opening 79 and heating element 64. The receptacle constraint plate 80 is joined to the heating enclosure 58.

Figure 3B:
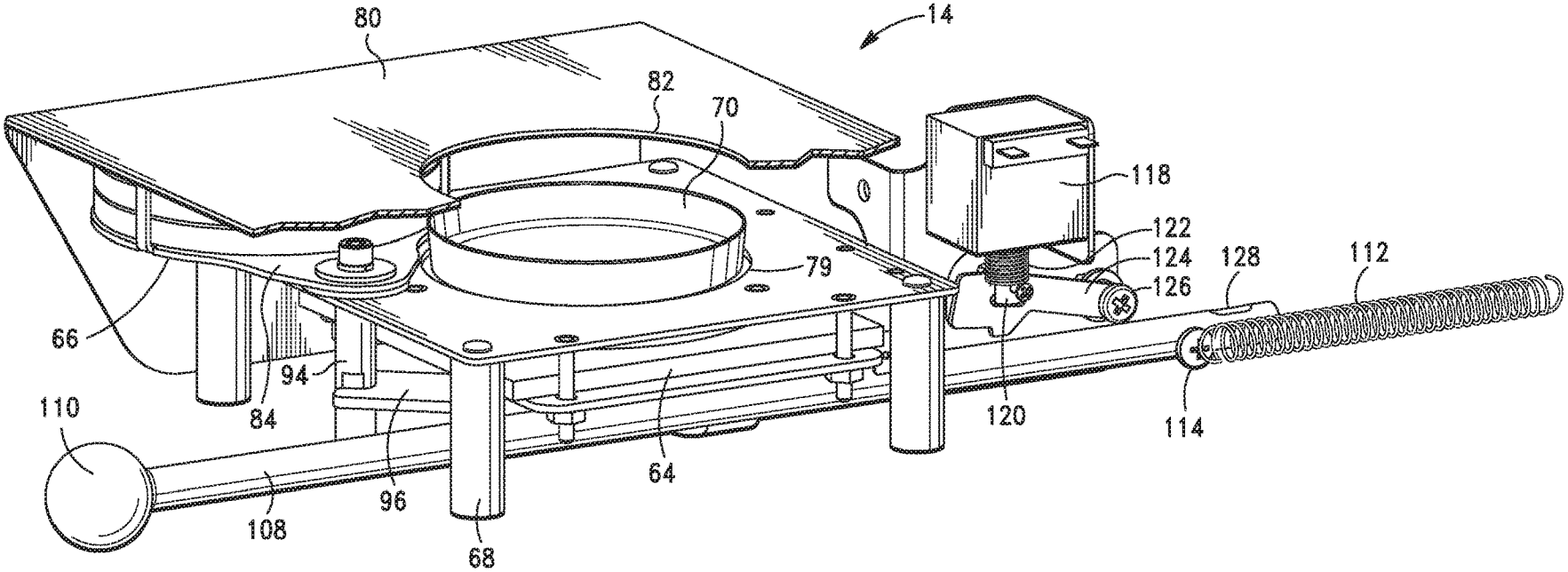
FIG. 3B is a perspective view of the heating apparatus of FIG. 3A showing the support and receptacle in a contact position.
Figure 4A:
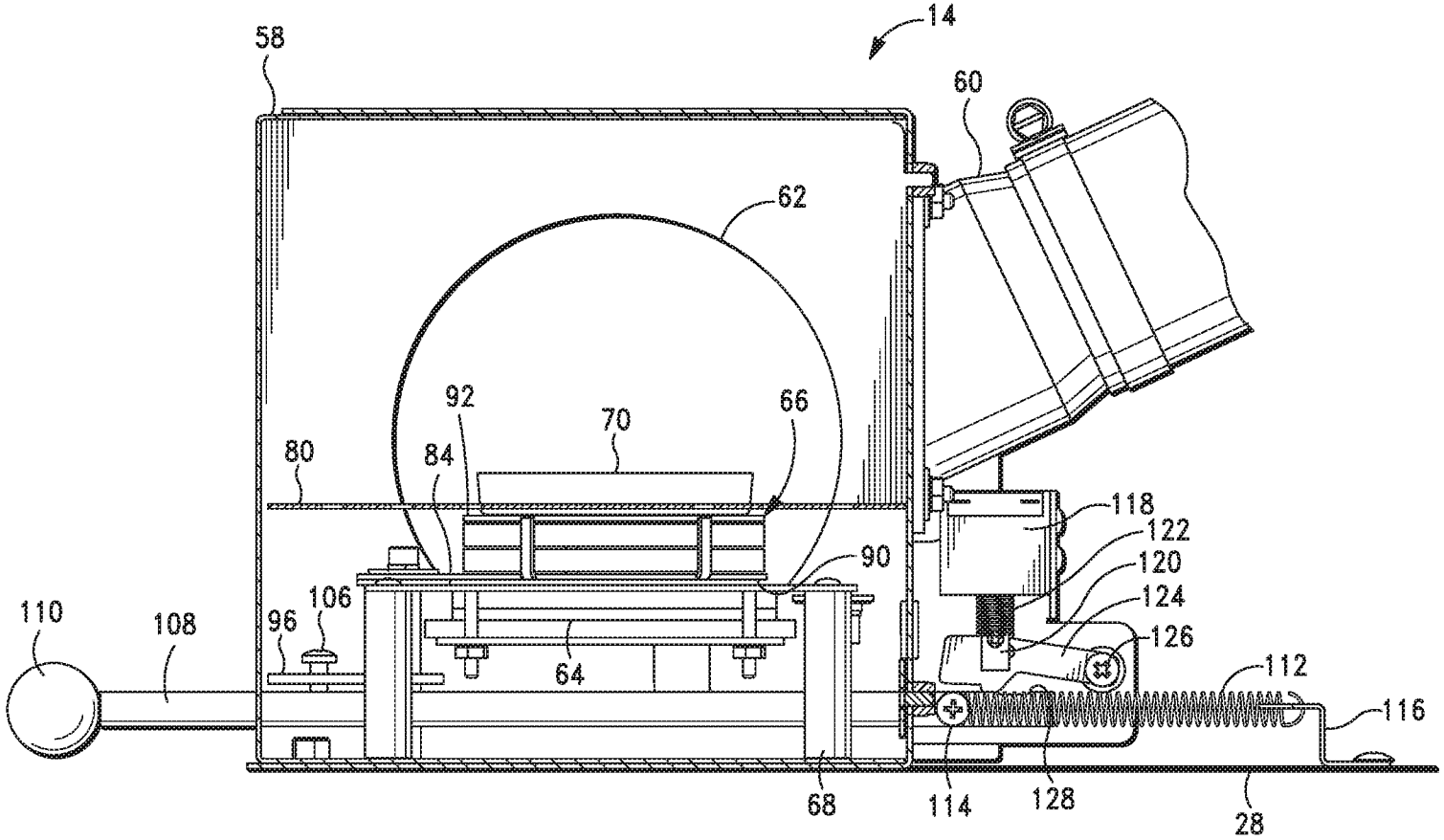
FIG. 4A is a side sectional view of the heating apparatus of FIG. 3A showing the support and receptacle in the non-contact position.
Figure 4B:
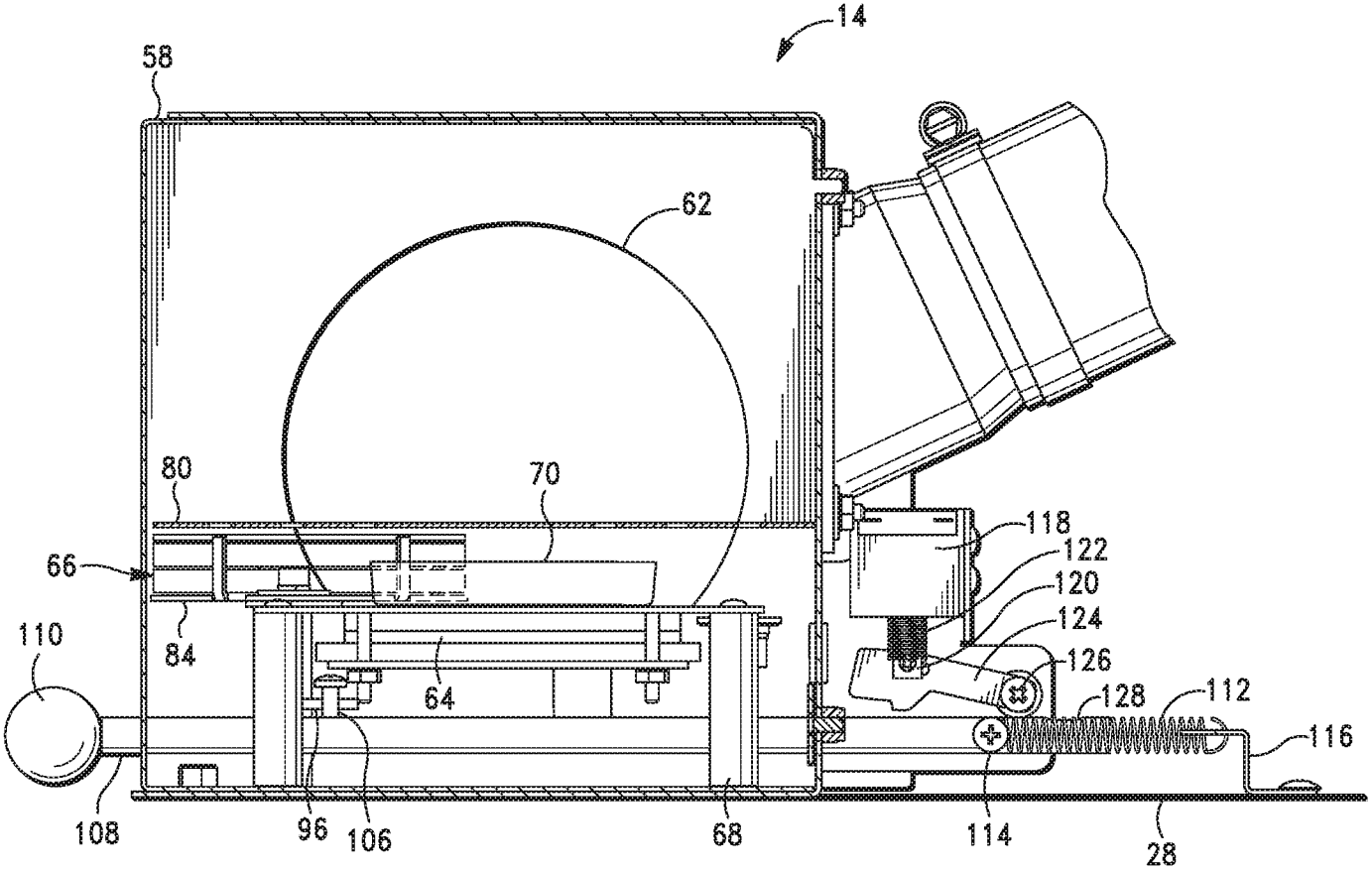
FIG. 4B is a side sectional view of the heating apparatus of FIG. 3A showing the support and receptacle in the contact position.

Moveable support 66 is moveable from a non-contact position shown in FIGS. 3A and 4A, in which it holds receptacle 70 above heating element 64 such that the receptacle 70 is not in contact with the heating element 64, to a contact position shown in FIGS. 3B and 4B, in which the receptacle 70 drops into contact with the heating element 64. Referring to FIG. 3A, moveable support 66 includes a moveable arm 84 and an upper platform 86 with insulating material 88 positioned between the arm 84 and platform 86. Referring to the non-contact position as shown in FIG. 4A, moveable support 66 has a first surface 90 facing the heating element 64 and a second surface 92 facing the receptacle 70. The first surface 90 preferably includes a layer of material to reduce thermal radiation transmittance. The layer of material is preferably aluminum and preferably has a thickness less than approximately 0.015 inches. Moveable arm 84 includes a circular portion 84*a* that underlies the circular insulating material 88 and a mounting portion 84*b* extending outward from the circular portion 84*a*. Moveable arm 84 and upper platform 86 are preferably formed from stainless steel or another rigid metal.

Insulating material 88 inhibits heat flow from first surface 90 to second surface 92, which is advantageous to prevent the undesired heating of a volatile component in receptacle 70 when heating element 64 is energized and moveable support 66 is in the non-contact position. Insulating material 88 preferably prevents the temperature of second surface 92 from increasing more than 15 degrees Celsius when heating element 64 is energized. Insulating material 88 is preferably selected from the group consisting of calcium silicate, silica ceramic, polytetrafluoroethylene, monolithic aerogel, and laminates and combinations of any of the foregoing. In certain embodiments, insulating material 88 may include a laminate comprising calcium silicate and polytetrafluoroethylene, a laminate comprising silica ceramic and polytetrafluoroethylene, and/or a laminate comprising polytetrafluoroethylene and monolithic aerogel.

With the insulating material 88 positioned between the heating element 64 and the volatile component in receptacle 70 when the receptacle 70 is in the non-contact position, the moveable arm 66 acts as a moveable barrier. The moveable arm 66 or barrier is moveable between the non-contact, or blocking position, in which the moveable arm 66 inhibits the transfer of heat from the heating element 64 to the receptacle 70, and the contact, or non-blocking position, in which the moveable arm 66 does not inhibit the transfer of heat from the heating element 64 to the receptacle 70 while the interior 42 and equipment chamber 46 remain sealed. Although in the embodiments shown in FIGS. 3A-4B the receptacle 70 is moved into direct contact with the heating element 64 in the contact, or non-blocking position, it is within the scope of the invention for the receptacle 70 to be placed adjacent to the heating element 64 in the contact or non-blocking position such that the heating element 64 can heat the receptacle 70 and volatile component therein without actually being in direct contact with the receptacle 70. A fuming enclosure modified to work in this manner may otherwise have a structure and operate in a similar manner as described herein with respect to the fuming enclosure 10 shown in FIGS. 1-4B & 7.

The mounting portion 84*b* of moveable arm 84 is mounted to a rotating assembly that includes a post 94 and a plate 96. Post 94 extends upward through an opening in top surface 74 of frame 68. Post 94 is rotatable within the opening in top surface 74. A fastener 98 is received by a threaded opening in post 94 to mount moveable arm 84 to post 94. A washer 100 is positioned between fastener 98 and moveable arm 84, and a spacer 102 is positioned between moveable arm 84 and top surface 74. Plate 96 is joined to post 94 and includes a slot 104 that receives a pin 106. The pin 106 is joined to and extends upward from a pull shaft 108. Pin 106 is preferably a screw that is received within a threaded opening of pull shaft 108, but may be joined to pull shaft 108 in any manner. Pull shaft 108 is supported by openings in heating enclosure 58 and front wall 24. The openings are preferably sealed to prevent fumes and contaminants from entering or existing the heating enclosure 58 and fuming enclosure 10. A knob 110 is mounted to an end of pull shaft 108 adjacent an exterior side of front wall 24, as shown in FIG. 1. The end of pull shaft 108 opposite knob 110 is mounted to an extension spring 112 with a fastener 114. One end of extension spring 112 is mounted to pull shaft 108 and the other end is mounted to a bracket 116 via a hook on the extension spring 112 received by an opening in the bracket 116, as shown in FIGS. 4A-B. Bracket 116 is mounted to the bottom wall 26 of chamber 12.

An electromechanical solenoid 118 is mounted to a portion of heating enclosure 58 above pull shaft 108. Solenoid 118 includes a rod 120 that is moveable between the extended position shown in FIGS. 3A and 4A and the retracted position shown in FIGS. 3B and 4B. A compression spring 122 mounted to solenoid 118 and rod 120 biases the rod 120 to the extended position. When solenoid 118 is actuated, it retracts rod 120 to move rod 120 from the extended position to the retracted position. The end of rod 120 opposite solenoid 118 is mounted to a pawl 124. Pawl 124 is pivotably mounted to a portion of heating enclosure 58 with a fastener 126. When solenoid 118 is in the extended position and pull shaft 108 is in the non-contact position shown in FIGS. 3A and 4A, a portion of pawl 124 is received by a slot 128 in pull shaft 108 to maintain pull shaft 108 in the non-contact position against the biasing force of spring 112. When solenoid 118 is moved to the retracted position, pawl 124 is moved upward out of engagement with slot 128, and spring 112 moves pull shaft 108 to the contact position shown in FIGS. 3B and 4B.

When pull shaft 108 is in the non-contact position shown in FIGS. 3A and 4A, moveable support 66 is in the non-contact position covering heating element 64. When solenoid 118 is actuated to the retracted position, spring 112 moves pull shaft 108 to the contact position shown in FIGS. 3B and 4B. As pull shaft 108 moves from the non-contact position to the contact position, pin 106 exerts a force on plate 96 that causes rotation of plate 96 and post 94. As post 94 rotates, it causes moveable support 66 to rotate from the non-contact position shown in FIGS. 3A and 4A to the contact position shown in FIGS. 3B and 4B. In the non-contact position, an upper surface of the platform 86 of moveable support 66 supports the receptacle 70 above and away from the heating element 64 so that the receptacle 70 does not make contact with the heating element 64 and so that the insulating material 88 is positioned between the heating element 64 and receptacle 70. In the contact position, moveable support 66 does not cover heating element 64. As moveable support 66 rotates from the non-contact position to the contact position, lateral or horizontal movement of receptacle 70 is prevented by receptacle constraint plate 80. Thus, receptacle 70 remains in place within the opening 82 of receptacle constraint plate 80 until moveable support 66 is removed from underneath receptacle 70 and opening 82. At that time, receptacle 70 drops vertically into contact with heating element 64. When it is desired to reset moveable support 66 back to the non-contact position and all fumes have been exhausted from interior 42, a user outside of the enclosure may open door 50 (FIG. 1), move receptacle 70 off of heating element 64, grasp knob 110, and pull the pull shaft 108 to manually move the moveable support 66 back to the non-contact position where it is held in place by pawl 124 and shaft 128.

Although fuming enclosure 10 is shown with a pull shaft 108 that moves the moveable support 66, another type of actuator may be used to move the moveable support 66. Further, rather than using solenoid 118 to move the pull shaft 108 and moveable support 66 from the non-contact position to the contact position, fuming enclosure 10 may include structure for manually moving the pawl 124 upward out of engagement with slot 128.

Humidification system 16 is positioned within equipment chamber 46 above heating apparatus 14. Humidification system 16 includes a humidifier 130, shown in FIG. 7, that is operable to vaporize liquid water placed into fluid communication with humidifier 130. The humidifier 130 preferably includes a water inlet (not shown) operable to receive water from a water container placed within humidification system 16 by a user through door 48. Humidification system 16 includes an air inlet 132, shown in FIG. 2, that is in fluid communication with recirculation system 18 and an air outlet that is aligned with the humidification opening 54 in interior wall 36. Humidifier 130 is preferably operable to regulate the humidity within interior 42 to a specified relative humidity between 20 to 80% in 1% increments.

Recirculation system 18 is positioned within equipment chamber 46 above humidification system 16. Recirculation system 18 includes a recirculation blower 134 (FIG. 7) that is operable to draw air and fumes from interior 42 through the recirculation opening 52 and force the air and fumes out through an outlet 136 of the recirculation system 18. The outlet 136 is connected to a conduit 138 that leads to the inlet 132 of the humidification system 16 and the inlet 60 of the heating enclosure 58. Air drawn by the recirculation blower 134 passes through the humidification system 16 to pick up water vapor and increase the humidity within interior 42. Further, air drawn by the recirculation blower 134 passes through the heating apparatus 14 to pick up fumes from a heated volatile component in receptacle 70 and distribute those volatile component fumes within interior 42. Recirculation system 18 preferably assists in ensuring a relatively even distribution of humidity and volatile component fumes within interior 42. Further, recirculation system 18 preferably reduces the time it takes to increase the humidity within interior 42 to a desired level and increase the concentration of volatile component fumes within interior 42 to a desired level.

Exhaust system 20 (FIG. 7) includes an exhaust blower 19 that is positioned within equipment chamber 46 and outside sealed interior 42. The exhaust blower 19 is in fluid communication with an exhaust plenum 23 adjacent top wall 26. Exhaust plenum 23 is in fluid communication with interior 42 through carbon filter 21. The exhaust blower is also in fluid communication through carbon filter 21 with an exhaust outlet (not shown) in rear wall 34 to place exhaust system 20 in fluid communication with the atmosphere surrounding the fuming enclosure 10. When the exhaust blower is powered on, it is operable to draw air, fumes, and contaminants from within the sealed interior 42 through the carbon filter 21 and clean the air of fumes and contaminants, moving the clean air through the exhaust outlet. When the exhaust blower is powered on, an air inlet valve (not shown) located adjacent to side wall 30 opens to let clean air into the interior 42 while contaminated air is pulled through the carbon filter 21 by the exhaust blower 19. The air inlet valve remains closed until the fuming process is complete and exhaust system 20 is powered on.

Figure 7:
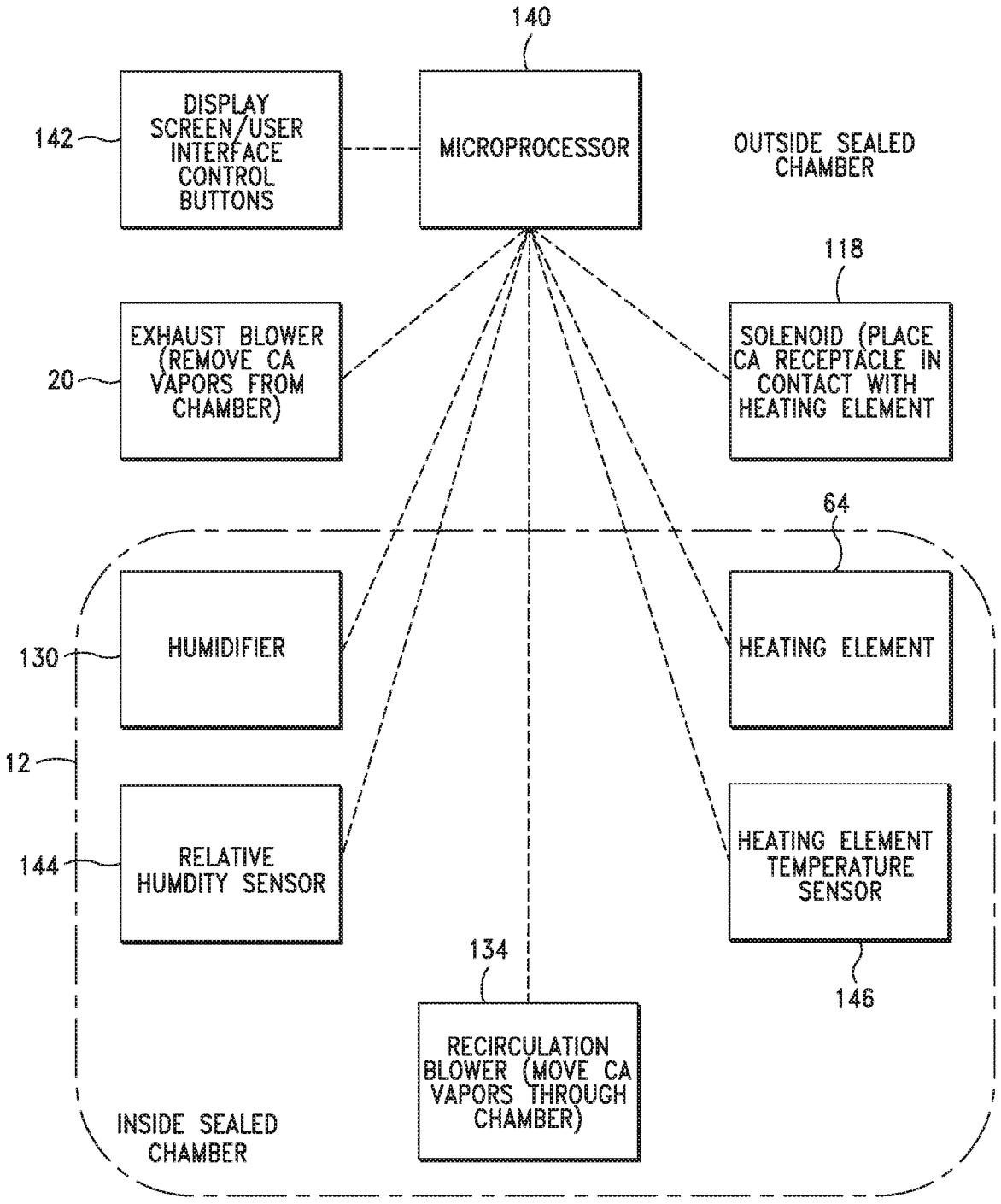
FIG. 7 is a schematic diagram of the fuming enclosure of FIG. 1.

Control system 22 (FIG. 1) includes a microprocessor 140 (FIG. 7) that is electrically coupled to a user interface 142, a relative humidity sensor 144, and a heating element temperature sensor 146. As shown in FIG. 7, microprocessor 140 is also electrically coupled to exhaust system 20, the air inlet valve, solenoid 118, humidifier 130, heating element 64, and recirculation blower 134 so that microprocessor 140 may send instructions to turn these systems on or off as desired. Microprocessor 140 may also be connected to a memory storage device (not shown) for processing software or instructions stored in the memory storage device and for storing data in the memory storage device. User interface 142 preferably includes a display screen for displaying information to a user and a user input device, such as buttons, operable to receive instructions from a user. The display screen may also be a touch screen that is operable to receive instructions from a user. The user interface 142 may be operable to receive user instructions for variables such as: desired relative humidity level; desired heating element temperature; humidity cycle run time; heating cycle run time; exhaust blower run time; and recirculation blower run time. A memory storage device linked to processor 140 may also store executable programs that include values for each of these variables. The user interface 142 may be operable to select one or more of the programs for execution by microprocessor 140. Relative humidity sensor 144 is preferably positioned within interior 42 for sensing the relative humidity level within interior 42 and relaying the same to microprocessor 140. Heating element temperature sensor 146 is preferably coupled to heating element 64 for sensing the temperature of heating element 64 and relaying the same to microprocessor 140.

Microprocessor 140 is electrically coupled to solenoid 118 for controlling movement of pull shaft 108 and moveable support 66 from the non-contact position shown in FIGS. 3A and 4A to the contact position shown in FIGS. 3B and 4B. Microprocessor 140 is operable to send instructions to solenoid 118 that causes the solenoid 118 to actuate, which moves pawl 124 upward out of engagement with slot 128, and causes pull shaft 108 and moveable support 66 to move from the non-contact position to the contact position. When moveable support 66 moves to the contact position, receptacle 70 drops into contact with heating element 64 to begin heating the volatile component within receptacle 70. Preferably, microprocessor 140 causes the moveable support 66 to move to the contact position when heating element 64 reaches a specified, pre-selected temperature as sensed by heating element temperature sensor 146.

Figure 5A:
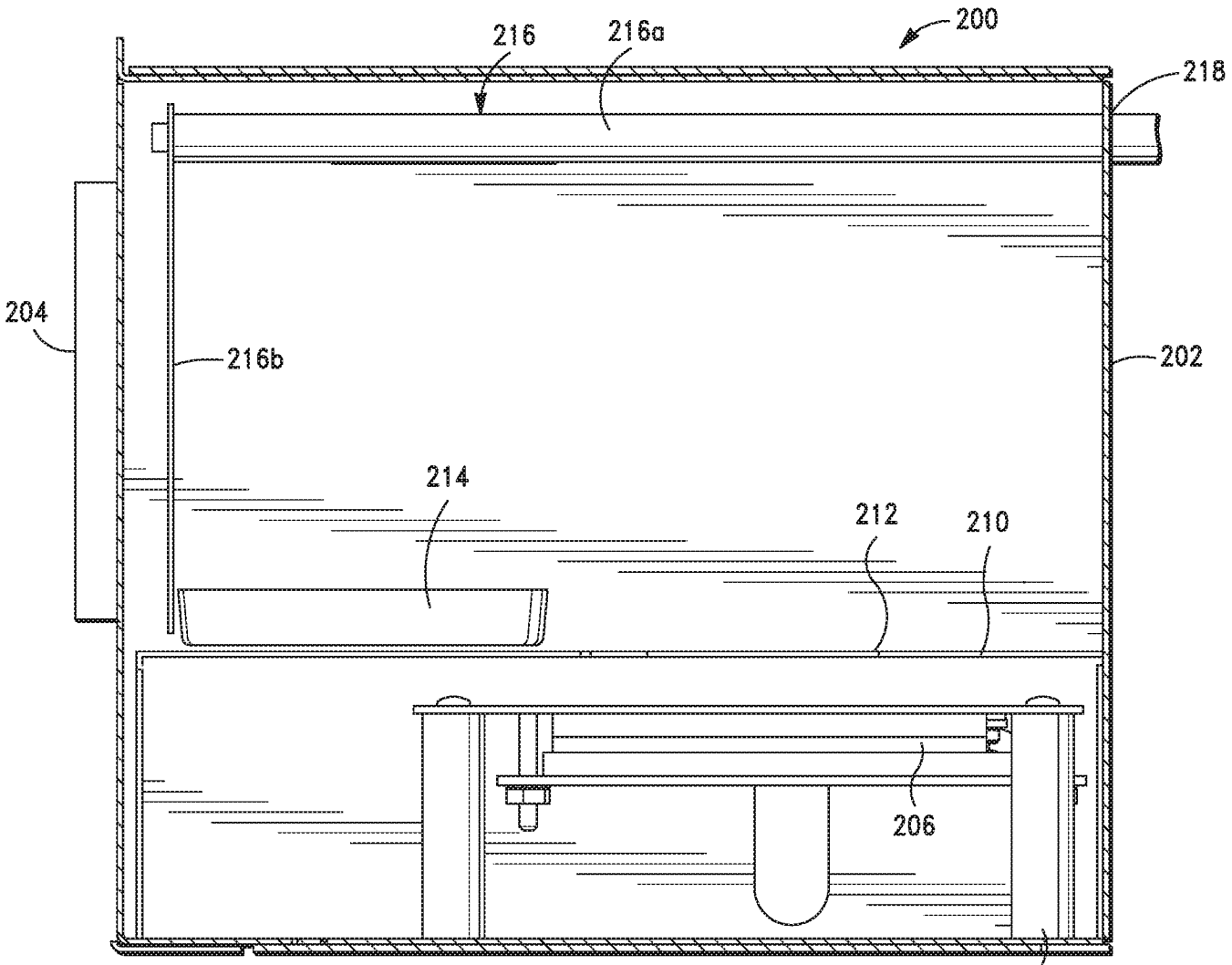
FIG. 5A is a front sectional view of an alternative embodiment of heating apparatus showing a receptacle in a non-contact position.
Figure 5B:
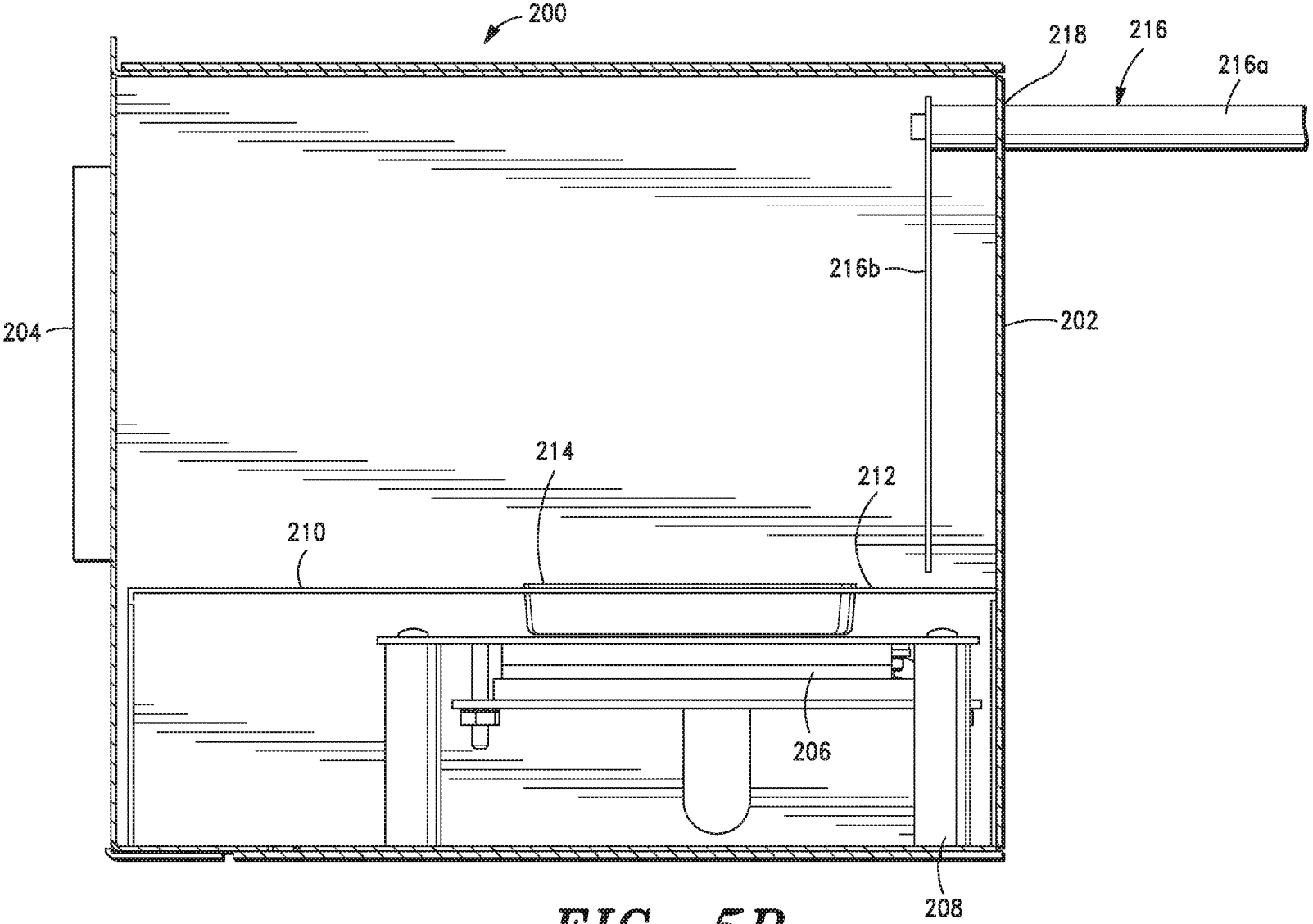
FIG. 5B is a front sectional view of the heating apparatus of FIG. 5A showing the receptacle in a contact position.

An alternative embodiment of heating apparatus 200 for use with fuming enclosure 10 is shown in FIGS. 5A-B. Heating apparatus 200 may be substituted for heating apparatus 14 shown in FIGS. 3A-4B. Heating apparatus 200 includes a heating enclosure 202 with an inlet (not shown) and an outlet 204. Heating apparatus 200 includes a heating element 206 and frame 208 that are substantially similar to the heating element 64 and frame 68 of heating apparatus 14. A receptacle constraint plate 210 has a similar construction as receptacle constraint plate 80 with an opening 212 positioned above heating element 206. A receptacle 214 is supported by receptacle constraint plate 210. A moveable arm 216 is at least partially positioned within heating enclosure 202. The moveable arm 216 includes a first section 216*a* that is positioned above and generally parallel with receptacle constraint plate 210. First section 216*a* extends through a sealed opening 218 in heating enclosure 202. The moveable arm 216 includes a second section 216*b* that is joined with an end of first section 216*a* within heating enclosure 202 and that extends downward from first section 216*a* to adjacent receptacle constraint plate 210.

Moveable arm 216 is moveable between the non-contact position shown in FIG. 5A and the contact position shown in FIG. 5B. In the non-contact position, receptacle 214 is not in contact with heating element 206 and is spaced a distance from heating element 206 so that heating element 206 does not significantly heat a volatile component within receptacle 214. In the contact position, receptacle 214 is in contact with heating element 206 to heat the volatile component when heating element 206 is energized. The second section 216*b* of moveable arm 216 moves the receptacle 214 across the receptacle constraint plate 210 from the non-contact position to the contact position. The receptacle 214 drops through opening 212 into contact with heating element 206 when in the contact position.

First section 216*a* of moveable arm 216 may extend outside of the side wall 12 (FIG. 1) for manual movement by an operator of the fuming enclosure 10. Moveable arm 216 may also be coupled to a solenoid or motor that receives instructions from microprocessor 140 to move moveable arm 216 from the non-contact position to the contact position when heating element 206 reaches a desired temperature as measured by heating element temperature sensor 146. The moveable arm 216 may also be reset from the contact position to the non-contact position either manually or via a solenoid or motor.

Another alternative embodiment of heating apparatus 300 for use with fuming enclosure 10 is shown in FIGS. 6A-6E. Heating apparatus 300 may be substituted for heating apparatus 14 shown in FIGS. 3A-4B. Heating apparatus 300 includes a heating enclosure 302 with an inlet (not shown) and an outlet 304. Heating apparatus 300 includes a heating element 306 and frame 308 that are substantially similar to the heating element 64 and frame 68 of heating apparatus 14. A receptacle constraint plate 310 has a similar construction as receptacle constraint plate 80 with an opening 312 positioned above heating element 306. A receptacle 314 is received by the opening 312 in receptacle constraint plate 310 where the receptacle 314 is in direct contact with heating element 306.

An opening 316 is formed in the side of heating enclosure 302. A one-way seal 318 is received by opening 316 and prevents air, fumes, and contaminants within the heating enclosure 302 from passing through opening 316 to the exterior of the fuming enclosure 10. Seal 318 includes a cylindrical base 320 that is positioned outside of the heating enclosure 302 and a conical section 322 that extends from the cylindrical base 320 into heating enclosure 302. The end of conical section 322 includes a slit 324 that is naturally biased to a closed position, as shown in FIGS. 6B and 6C, to prevent fumes from exiting the heating enclosure 302. When a conduit 326 (FIG. 6A) is inserted through the seal 318 from the exterior of the heating enclosure 302, the slit 324 moves to an open position, as shown in FIGS. 6D and 6E. In the open position, the portion of seal 318 surrounding slit 324 sealingly engages the conduit 326 to prevent fumes from exiting the heating enclosure 302. A volatile component 328 may be introduced into the heating enclosure 302 through the conduit 326 when the slit 324 is in the open position. The volatile component 328 preferably flows through the conduit 326 into receptacle 314. Thus, the seal 318 acts as a one-way seal that permits the flow of material through the seal 318 in one direction only (i.e., from outside the heating enclosure 302 to inside the heating enclosure 302) while preventing the flow of material through the seal in the opposite direction (i.e., from inside the heating enclosure 302 to outside the heating enclosure 302). Seal 318 maintains sealing engagement with the conduit 326 and heating enclosure 302 to prevent fumes from escaping the heating enclosure 302 while the volatile component 328 is added to the receptacle 314.

Seal 318 and conduit 326 may be operated manually or automatically. In manual operation, a user preferably fills conduit 326 with a volatile component, inserts the conduit 326 through the slit 324, and then dispenses the volatile component 328 into the receptacle 314. The user may dispense the volatile component 328 into the receptacle 314 either before the heating element 306 is energized or after the heating element 306 reaches a desired temperature. The user may dispense the volatile component 328 physically by, for example, squeezing a bulb on the end of the conduit 326. Alternatively, if the seal 318 and conduit 326 are electrically coupled to a dispensing system, such as a metering pump, user may manually initiate the dispensing of volatile component 328 through the conduit 326 by activating the dispensing system. Seal 318 is configured to allow a user to manually insert conduit 326 through the seal 318 and dispense the volatile component 328 through the conduit 326 into the receptacle 314 while doors 38, 48, and 50 are locked and sealed.

If the seal 318 and conduit 326 are operated automatically, preferably, seal 318 and conduit 326 are electrically connected to microprocessor 140 so that microprocessor 140 can automatically control the dispensing of volatile component 328 through the seal 318 and conduit 326. In one embodiment, conduit 326 may be connected to an automated dispensing system including a metering pump. The automated dispensing system may be electrically connected to microprocessor 140 so that microprocessor 140 can send instructions to activate and deactivate the automated dispensing system as desired. For example, the microprocessor 140 may send instructions to activate the automated dispensing system to pump volatile component 328 through seal 318 and conduit 326 into receptacle 314 when the heating element 306 reaches a specified, pre-selected temperature. After a desired amount of volatile component is pumped into receptacle 314, the microprocessor 140 may send instructions to deactivate the automated dispensing system. When operated automatically, seal 318 permits the flow of volatile component 328 through conduit 326 into the receptacle 314 within heating enclosure 302 while doors 38, 48, and 50 are locked and sealed and heating element 306 is energized and has reached a pre-selected temperature.

Figure 8:
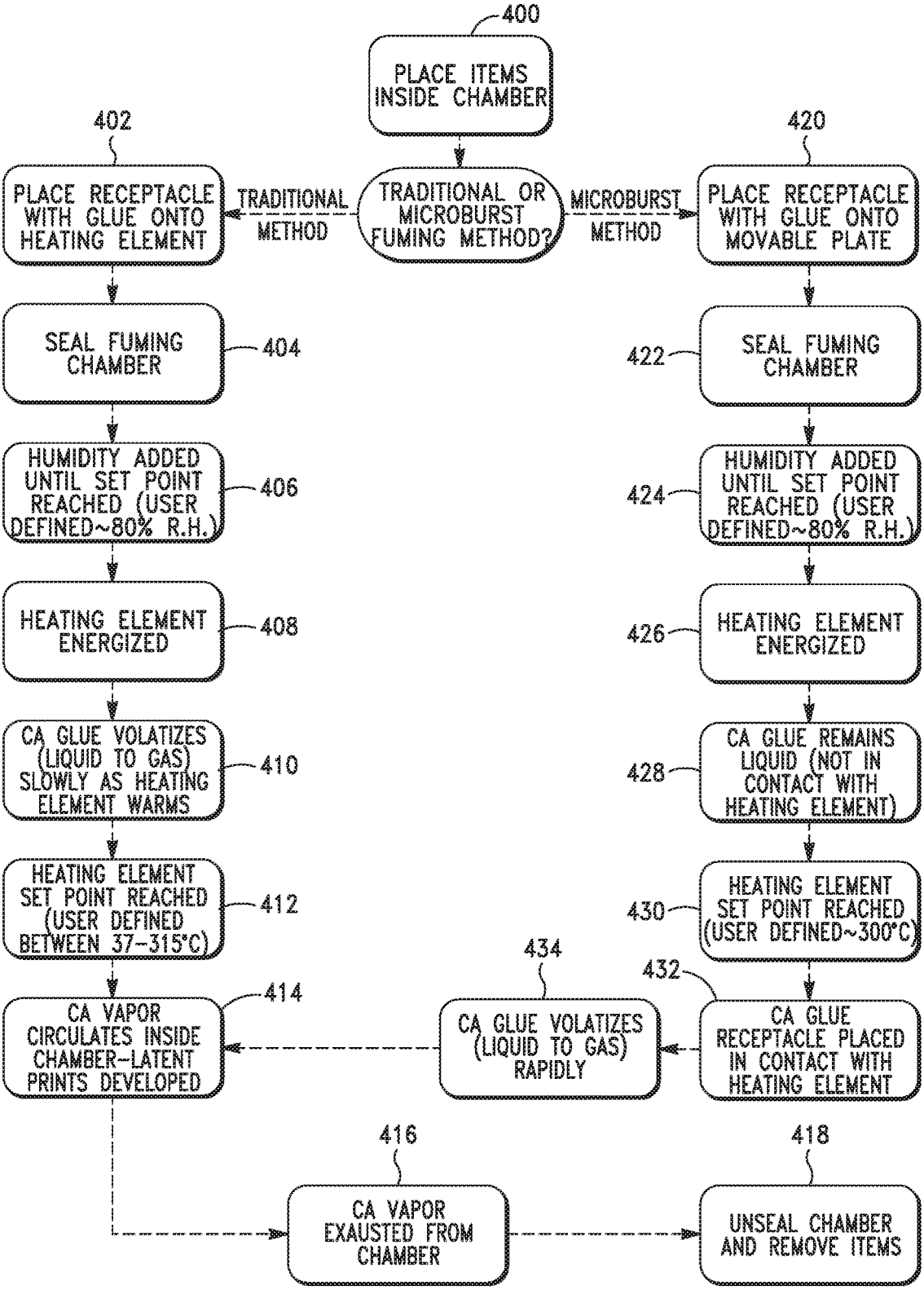
FIG. 8 is a flow chart of a method of operation of the fuming enclosure of FIG. 1.

In operation, as shown in FIG. 8, fuming enclosure 10 is configured for use in accordance with a traditional fuming method or a microburst fuming method. Under either method, the user first opens door 38 and places items within interior 42 at step 400. Door 38 is then latched and locked to seal interior 42. The user may select on user interface 142 whether to use the traditional or microburst fuming method. The user may select values on user interface 142 for desired variables such as relative humidity level; desired temperature; humidity cycle run time; heating cycle run time; exhaust blower run time; and recirculation blower run time. The user may also select from various programs on user interface 142 for execution that include preprogrammed values for the variables listed above.

In the traditional method, moveable arm 66 is moved to the contact position shown in FIGS. 3B and 4B. If moveable arm 66 is not already in the contact position, the user may instruct user interface 142 to activate solenoid 118, which moves pull shaft 108 and moveable arm 66 to the contact position. At step 402, the user then opens door 50 and places a volatile component, such as cyanoacrylate glue, within receptacle 70. The receptacle 70 is placed in contact with heating element 64. If necessary, water is added to humidifier 130 through door 48. All doors 38, 48, and 50 are shut and sealed at step 404 to prevent fumes from exiting interior 42 and equipment chamber 46. The user may then select start on user interface 142 to start the fuming process.

At step 406, control system 22 instructs humidification system 16 to begin raising the relative humidity level within interior 42 until the desired relative humidity level is reached as sensed by relative humidity sensor 144. Control system 22 also instructs recirculation system 18 to blow air through the humidification system 16 to assist in raising the relative humidity level within interior 42. Once the desired relative humidity level within interior 42 is reached, which is preferably around 80%, control system 22 instructs humidification system 16 to shut off. Control system 22 then instructs heating element 64 to begin heating at step 408. Heating element 64 energizes and begins heating receptacle 70 and the volatile component placed therein. At step 410, the volatile component within receptacle 70 begins to change phase from a solid or liquid to a gas as it is heated. Recirculation system 18 blows through heating apparatus 14 to distribute the heated volatile component fumes throughout interior 42. Heating element 64 increases in temperature until heating element temperature sensor 146 senses that the desired heating element temperature has been reached at step 412, which is preferably between 37 to 315 degrees Celsius. At this time, control system 22 manages power to the heating element 64 to maintain heating element at a user-desired pre-selected temperature. As the recirculation system 18 distributes the volatile component fumes through interior 42, the fumes react with latent fingerprints on the objects placed within interior 42 to make the fingerprints visible at step 414.

After the heating element 64 has been energized for a desired heating cycle run time, control system 22 instructs exhaust system 20 to turn on and exhaust all of the volatile component fumes from within interior 42 at step 416. Once all of the volatile component fumes have been exhausted from interior 42, the user may open door 38 to retrieve the items from within interior 42.

Figure 9:
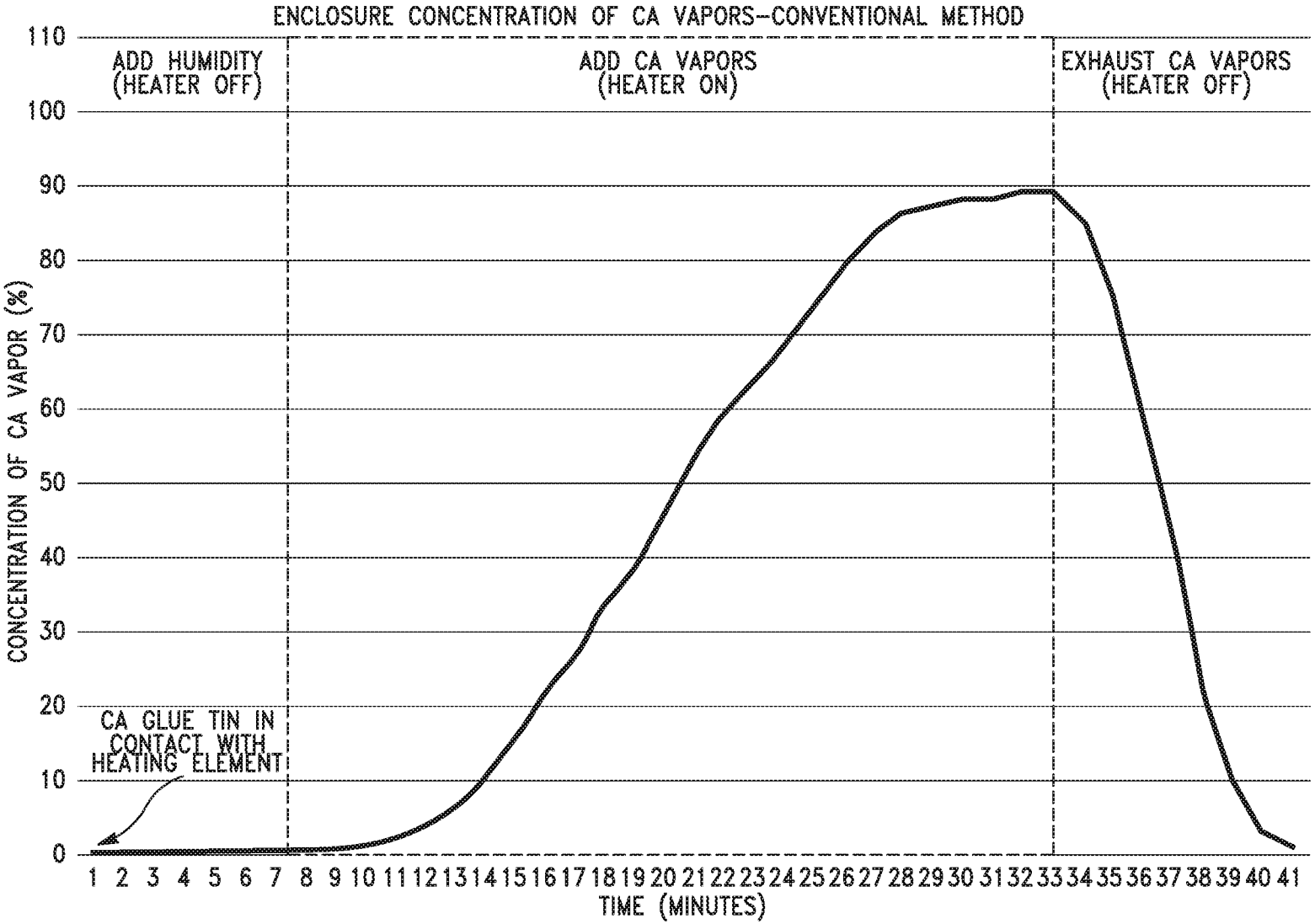
FIG. 9 is a graph showing the concentration of cyanoacrylate vapors in a fuming enclosure over time using a conventional heating method.

FIG. 9 is a graph showing the concentration of volatile component, or cyanoacrylate, fumes within interior 42 over time when fuming enclosure 10 operates in the traditional fuming method. As shown in FIG. 9, it takes approximately seven minutes to raise the relative humidity within interior 42 to the desired level, at which time heating element 64 is energized. Heating element 64 is energized for approximately 26 minutes, which raises the concentration of volatile component vapors within interior to a level of approximately 90%. Exhaust system 20 then runs for approximately 8 minutes to exhaust substantially all of the volatile component fumes from within interior 42.

Referring back to FIG. 8, in the microburst method, after the items are placed within interior 42 at step 400 and the user selects the appropriate values on user interface 142, the moveable arm 66 is first set to the non-contact position shown in FIGS. 3A and 4A by pulling pull shaft 108 until pawl 124 engages slot 128. The receptacle 70 is filled with a volatile component and placed on top of moveable arm 66 at step 420. All doors 38, 48, and 50 are shut and sealed at step 422 to prevent fumes from exiting interior 42 and equipment chamber 46. The humidity within interior 42 is then increased to a desired level at step 424 in the same manner as with the traditional method at step 406. Once the desired relative humidity level within interior 42 is reached, which is preferably around 80%, control system 22 instructs humidification system 16 to shut off. Control system 22 then instructs heating element 64 to begin heating at step 426. While the heating element 64 begins heating to its desired heating element temperature, the receptacle 70 remains on top of the moveable arm 66 separated from the heating element 64 by the insulating material 88. The insulating material 88 ensures that the volatile component does not heat to a level that would significantly cause it to change phase from solid or liquid to gas at step 428. When the heating element temperature sensor 146 senses that the heating element 64 has reached the desired temperature at step 430, the control system 22 instructs solenoid 118 to actuate and retract pawl 124 from slot 128. Pull shaft 108 and moveable arm 66 then move to the contact position shown in FIGS. 3B and 4B. As pull shaft 108 and moveable arm 66 move to the contact position, receptacle 70 drops into contact with heating element 64 at step 432. The volatile component within receptacle 70 rapidly heats and changes phase from solid or liquid to gas at step 434. Recirculation system 18 blows the volatile component fumes into interior 42 to increase the concentration of volatile component fumes within interior 42. The process then moves to steps 414, 416, and 418, which are carried out in substantially the same manner as discussed above with respect to the traditional fuming process.

As an alternative to the microburst method described above, moveable arm 66 may be a moveable barrier that is positioned between receptacle 70 and heating element 64 in a blocking position. Then, at step 432, the control system 22 sends a signal to the moveable barrier to move it into a non-blocking position, in which the receptacle 70 is placed adjacent the heating element 64 in a position where the heating element 64 can heat the volatile component within receptacle 70 and cause it to change phase from solid or liquid to gas. In the non-blocking position, the receptacle 70 does not necessarily need to be in direct contact with heating element 64.

Figure 10:
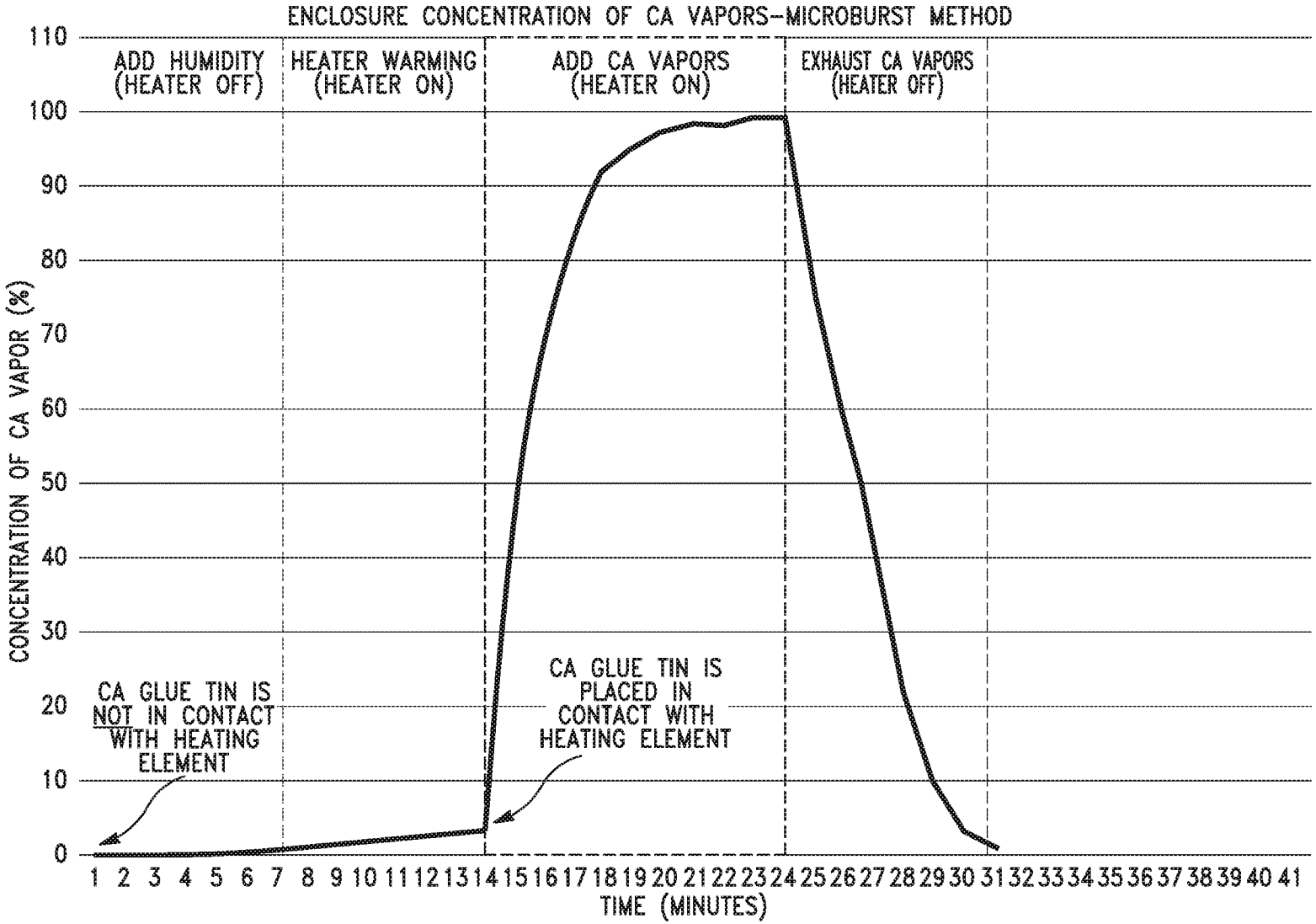
FIG. 10 is a graph showing the concentration of cyanoacrylate vapors in a fuming enclosure over time using a microburst heating method.

FIG. 10 is a graph showing the concentration of volatile component, or cyanoacrylate, fumes within interior 42 over time when fuming enclosure 10 operates in the microburst fuming method. As shown in FIG. 10, it takes approximately seven minutes to raise the relative humidity within interior 42 to the desired level, at which time heating element 64 is energized. Heating element 64 is warmed to a desired level for approximately 7 minutes, at which time, the moveable arm 66 moves to allow the volatile component within receptacle 70 to be heated. The volatile component is rapidly heated to raise the concentration of volatile component vapors within interior 42 to a level of approximately 100% in ten minutes. Exhaust system 20 then runs for approximately 8 minutes to exhaust substantially all of the volatile component fumes from within interior 42. Thus, the microburst fuming method raises the concentration of volatile component vapors within interior to the required concentration for fuming latent fingerprints in 24 minutes from the start of the process, while the traditional fuming method raises the concentration of volatile component vapors within interior to the required concentration for fuming latent fingerprints in 33 minutes from the start of the process.

Use of fuming enclosure 10 in either the traditional method or the microburst method protects personnel from exposure to volatile component fumes and the risk of being burned by heating element 64 because the doors 38, 48, and 50 may all be shut, locked, and sealed before heating element 64 is energized. The doors 38, 48, and 50 preferably remain locked and sealed until exhaust system 20 has completed its exhaust cycle and exhausted substantially all of the fumes from interior 42.

If fuming enclosure 10 includes the alternative embodiment of heating apparatus 200, shown in FIGS. 5A and 5B, the fuming enclosure 10 operates in substantially the same manner as described above. The exception is that when used in the microburst method, at step 432, moveable arm 216 is pulled to slide the receptacle 214 into contact with heating element 206, as shown in FIG. 5B. The moveable arm 216 may be pulled manually by an operator after the user interface 142 instructs the operator that it is time to pull the arm 216. Alternatively, the control system 22 may instruct a motor or solenoid to activate and pull the arm 216 to the contact position shown in FIG. 5B.

Figure 6A:
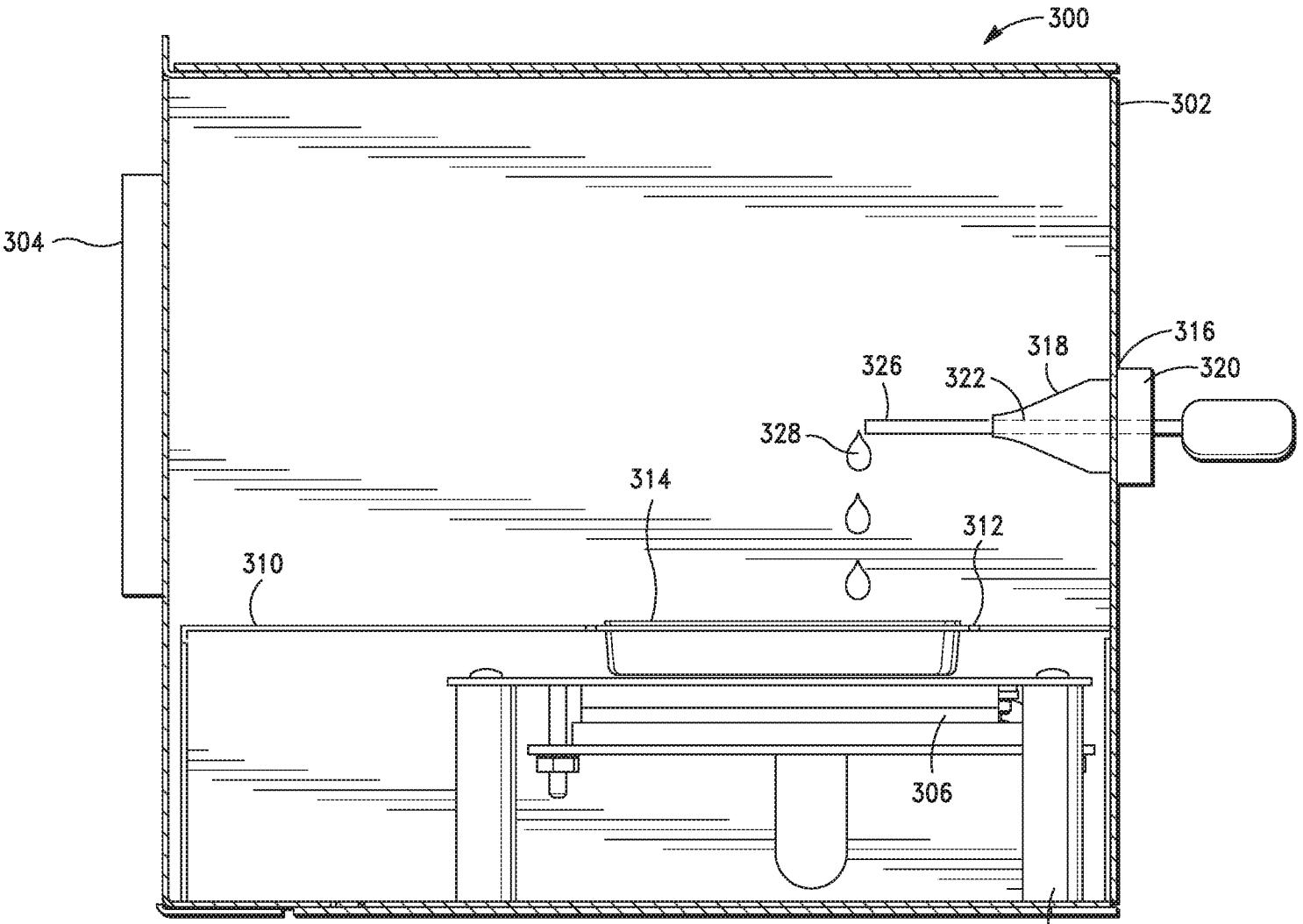
FIG. 6A is a front sectional view of another alternative embodiment of heating apparatus having a one-way seal and conduit.
Figure 6B:
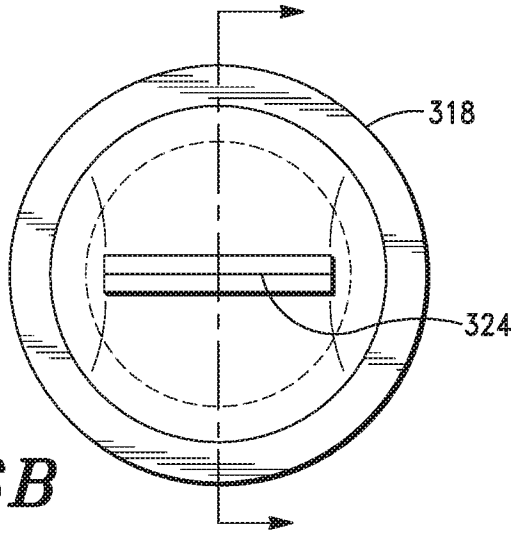
FIGS. 6B-6C show the seal of FIG. 6A in a closed position.
Figure 6C:
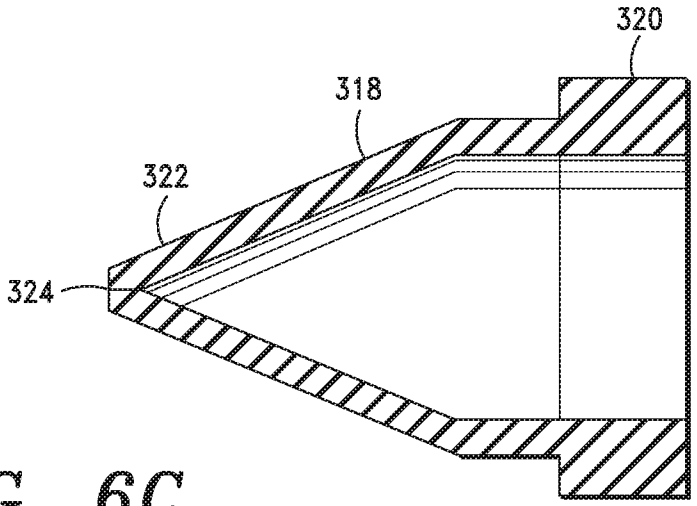
Figure 6D:
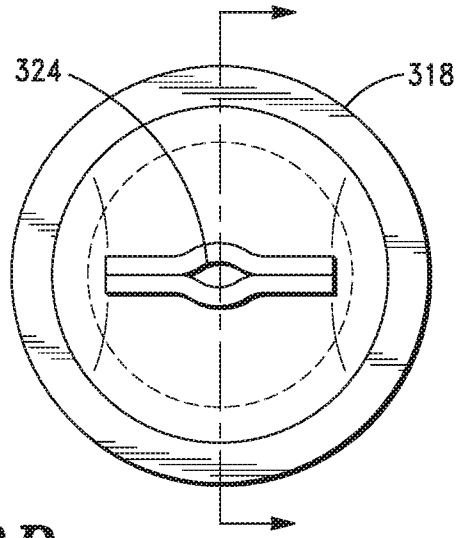
FIGS. 6D-6E show the seal of FIG. 6A in an open position.
Figure 6E:
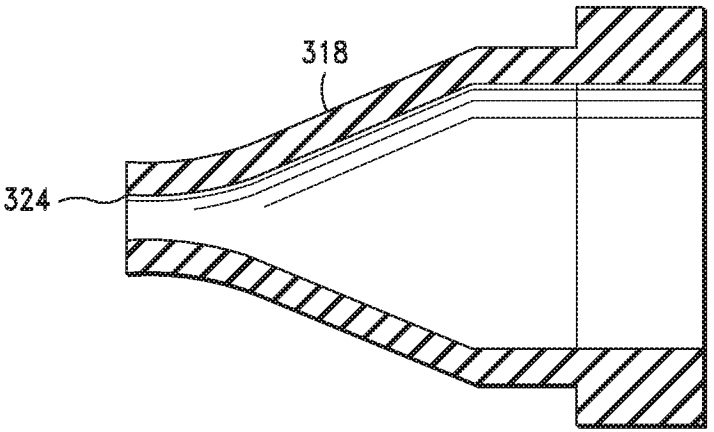

If fuming enclosure 10 includes the alternative embodiment of heating apparatus 300, shown in FIGS. 6A and 6B, the fuming enclosure 10 operates in substantially the same manner as described above. The exception is that when used in the microburst method, the receptacle 314 is always in contact with (or adjacent to) the heating element 306 but volatile component 328 is not added to the receptacle 314 until step 432. At step 432, volatile component 328 flows through conduit 326 and into receptacle 314. The volatile component 328 may be manually dispensed by an operator after the user interface 142 instructs the operator that it is time to begin heating the volatile component 328. Alternatively, the control system 22 may instruct an automated dispensing system to activate and dispense the volatile component 328 into receptacle 314.

From the foregoing it will be seen that this invention is one well adapted to attain all ends and objectives hereinabove set forth, together with the other advantages which are obvious and which are inherent to the invention.

Since many possible embodiments may be made of the invention without departing from the scope thereof, it is to be understood that all matters herein set forth or shown in the accompanying drawings are to be interpreted as illustrative, and not in a limiting sense.

While specific embodiments have been shown and discussed, various modifications may of course be made, and the invention is not limited to the specific forms or arrangement of parts and steps described herein, except insofar as such limitations are included in the following claims. Further, it will be understood that certain features and subcombinations are of utility and may be employed without reference to other features and subcombinations. This is contemplated by and is within the scope of the claims.

What is claimed and desired to be secured by Letters Patent is as follows:

1. A fuming enclosure in which the fumes of a volatile component may be circulated, said fuming enclosure comprising:

a. outer walls defining an enclosure having a sealed interior;

b. a receptacle configured to contain a volatile component;

c. a heating element positioned within said interior, said heating element operable to be energized to heat said receptacle containing said volatile component to a specified temperature when said receptacle is positioned in contact with at least a portion of said heating element; and d. a moveable support positioned within said interior, said support configured to hold said receptacle within said interior in a non-contact position such that the receptacle is not in contact with the heating element, and said moveable support configured to move said receptacle while the enclosure is sealed and said heating element is energized from the non-contact position to a contact position, in which the receptacle is in contact with said heating element, and wherein the moveable support is configured to move said receptacle from the non-contact position to the contact position in a manner that the volatile component remains in the receptacle prior to the volatile component being vaporized by the heating element, wherein said moveable support comprises a platform having an upper surface that supports said receptacle above said heating element in the non-contact position, said moveable support operable to be removed from underneath said receptacle to cause the receptacle to drop onto at least a portion of the heating element in the contact position.

2. The enclosure of claim 1, wherein said enclosure additionally comprises at least one door providing access to said interior, said at least one door operable to be locked to prevent access to said interior when said heating element is energized and said moveable support is configured to move said receptacle to the contact position while said at least one door is locked.

3. The enclosure of claim 1, wherein said moveable support is operable to be manually moved by a user from outside said enclosure via an actuator extending through said outer walls.

4. The enclosure of claim 1, wherein said moveable support is operable to automatically move said receptacle to the contact position upon at least a portion of said heating element reaching a pre-selected temperature.

5. The enclosure of claim 4, wherein said moveable support is electro-mechanically controlled by a microprocessor.

6. The enclosure of claim 5, wherein said microprocessor is in communication with said heating element and said moveable support such that said microprocessor directs movement of said moveable support upon said heating element reaching a pre-selected temperature.

7. The enclosure of claim 1, wherein said moveable support comprises a moveable arm that holds said receptacle in the non-contact position and is operable to move said receptacle to the contact position.

8. The enclosure of claim 1, wherein said moveable support has a first surface facing said heating element in the non-contact position and a second surface facing said receptacle in the non-contact position and wherein said moveable support comprises an insulating material that inhibits heat flow from said first surface to said second surface.

9. The enclosure of claim 1, wherein said enclosure is a fingerprint processing cabinet and said volatile component comprises cyanoacrylate.

10. The enclosure of claim 1, wherein said enclosure is configured to enable a user to elect to manually position said receptacle in contact with said heating element before said heating element is energized or to utilize said moveable support to position said receptacle in the contact position after said heating element is energized.

11. A fuming enclosure in which the fumes of a volatile component may be circulated, said fuming enclosure comprising:

a. outer walls defining an enclosure having a sealed interior;

b. a receptacle configured to contain a volatile component;

c. a heating element positioned within said interior, said heating element operable to be energized to heat said receptacle containing said volatile component to a specified temperature; and d. a moveable barrier positioned within said interior, said barrier configured to be positioned within the sealed interior of the enclosure in a blocking position between said receptacle and said heating element in such a manner as to inhibit the transfer of heat from said heating element to said receptacle and said barrier configured to be moved while said enclosure is sealed and said heating element is energized from the blocking position to a non-blocking position that does not inhibit the transfer of heat from said heating element to said receptacle, and wherein the barrier is configured to move from the blocking position to the non-blocking position in a manner that the volatile component remains in the receptacle prior to the volatile component being vaporized by the heating element, wherein said moveable barrier comprises a platform having an upper surface that supports said receptacle above said heating element in the blocking position, said moveable barrier operable to be removed from underneath said receptacle to cause the receptacle to drop onto at least a portion of the heating element in the non-blocking position.

12. The enclosure of claim 11, wherein said enclosure additionally comprises at least one door providing access to said interior, said at least one door operable to be locked to prevent access to said interior when said heating element is energized and said barrier is configured to be moved to said non-blocking position while said at least one door is locked.

13. The enclosure of claim 12, wherein said enclosure is a fingerprint processing cabinet and said volatile component comprises cyanoacrylate.

14. The enclosure of claim 12, wherein said enclosure is configured to enable a user to elect to manually position said receptacle adjacent said heating element without the moveable barrier positioned therebetween before said heating element is energized or to utilize said moveable barrier to inhibit the transfer of heat to the receptacle after said heating element is energized.

15. The enclosure of claim 11, wherein said moveable barrier is operable to be manually moved by a user from outside said enclosure via an actuator extending through said outer walls.

16. The enclosure of claim 11, wherein said moveable barrier is operable to be automatically moved to the non-blocking position upon at least a portion of said heating element reaching a pre-selected temperature.

17. The enclosure of claim 16, wherein said moveable barrier is electro-mechanically controlled by a microprocessor.

18. The enclosure of claim 17, wherein said microprocessor is in communication with said heating element and said moveable barrier such that said microprocessor directs movement of said moveable barrier upon said heating element reaching a pre-selected temperature.

* * * * *